United States Patent [19]

Cooper et al.

[11] 4,218,063

[45] Aug. 19, 1980

[54] ELECTRONIC SYSTEM FOR PLAYING BINGO

[75] Inventors: Gary D. Cooper, College Park; Ronald D. Brigman, Huntingtown, both of Md.

[73] Assignee: G.L.S. Partnership, College Park, Md.

[21] Appl. No.: 884,234

[22] Filed: Mar. 7, 1978

[51] Int. Cl.[3] ..... A63F 3/06

[52] U.S. Cl. ..... 273/237; 273/269; 340/323 R; 235/92 GA

[58] Field of Search ..... 273/269, 270, 237, 238, 273/138 A; 35/48 R; 340/323 R, 165; 235/92 GA

[56] References Cited

U.S. PATENT DOCUMENTS

| | | | |
|---|---|---|---|
| 2,333,002 | 10/1943 | Goloborodka | 273/237 |
| 2,760,619 | 8/1956 | Peak | 273/238 X |
| 3,300,217 | 1/1967 | Franklin | 273/238 |
| 3,416,243 | 12/1968 | Greenberg | 35/48 R |
| 3,653,026 | 3/1972 | Hurley | 273/138 A |
| 3,671,041 | 6/1972 | Taylor | 273/237 |
| 3,848,230 | 11/1974 | Rehm | 35/13 |
| 4,080,596 | 3/1978 | Keck | 273/237 |

*Primary Examiner*—Richard J. Johnson
*Attorney, Agent, or Firm*—Blair, Brown & Kreten

[57] ABSTRACT

A system for playing bingo which includes a transmitter and at least one receiver. The transmitter includes a masterboard with associated ball-actuated switches which deliver signals in parallel format representing numbers in a bingo game. A parallel-to-series converter is provided to convert the signals into a series format. The receiver includes a series-to-parallel converter which effects a reconversion of the received signals into a parallel format and a flashboard which is coupled to outputs of the series-to-parallel converter and displays the numbers of a bingo game.

19 Claims, 4 Drawing Figures

ELECTRONIC SYSTEM FOR PLAYING BINGO

BACKGROUND OF THE INVENTION

This invention relates to an electronic system for use in playing bingo. The invention relates, more particularly, to an electronic bingo game system which includes a transmitter and at least one receiver, a masterboard forming a part of the transmitter and respective flashboard forming part of each receiver.

Conventional systems used in playing the game of bingo and the like include three major units, namely a blower unit, a masterboard and at least one flashboard positioned so as to be viewed by players.

The blower unit is a large glassed-in container in which forced air blows 75 numbered ping-pong type balls around to mix them up. Random balls are made available at an opening for the operator to retrieve, read and call.

The masterboard is a console type device which includes numbered apertures in the top of a metal box. Beneath each aperture is a switch which becomes closed whenever a ball contacts it and is open in the absence of a ball in its associated aperture. A ball, when placed in the proper aperture, activates the corresponding switch by compressing a spring which is held down by the ball.

The flashboard is a bill-board shaped unit usually having a plastic face with 75 numbers and the word BINGO on it. Behind each number is a light source. When a numbered ball is placed in its associated aperture on the masterboard, a corresponding one of the light sources becomes lit on the flashboard, illuminating that particular number.

There are many serious disadvantages with conventional systems. First, because the information is sent from the masterboard to the flashboard in parallel format, there must be one connecting wire for each light source and a heavy common bus. The size of the cable, typically contains 80 conductors, and the cost frequently limits the distance the masterboard and blower unit can be placed from the flashboard. Since the switches in the masterboard actually energize the light sources there is a limit to the number of flashboards which can be connected. These factors also limit the connection of accessories such as lights to indicate the type of game being played, and the like. The conventional system has no reasonable way to indicate which number is the last number called, a very critical aspect of the game. The conventional system also runs 110 V lines long distances, which wastes power, can be hazardous and is expensive.

SUMMARY OF THE INVENTION

It is an object of the present invention to provide an electronic system for use in playing bingo and the like which overcomes the need for feeding data from a masterboard to one or more flashboards in parallel format.

It is another object of the present invention to provide an electronic system for use in playing bingo and the like which greatly reduces the amount of wiring between the masterboard and one or more flashboards.

It is an additional object of the present invention to provide an electronic system for use in playing bingo and the like which allows the flashboard or flashboards to be placed at considerable distances from the blower unit and the masterboard at reduced expense, as compared to conventional systems.

It is a further object of the present invention to provide an electronic system for use in playing bingo and the like which allows virtually an unlimited number of flashboards to be used.

It is yet another object of the present invention to provide an electronic system for use in playing bingo and the like which avoids the need for running 110 V lines over great distances.

It is yet an additional object of the present invention to provide a transmitter suitable for use in the system.

It is yet a further object of the present invention to provide a receiver suitable for use in the system.

The foregoing objects are achieved by the present invention, in its system aspect, by providing a transmitter which includes a parallel-to-serial converter which encodes data supplied to it in parallel from sensors responsive to the presence of balls in respective apertures of a masterboard, the converter being controlled by a source of clock pulses. The data output from the converter, in serial format, is fed to a receiver, the first bit representing data also acting as a syncronization pulse. The receiver includes a serial-to-parallel converter, controlled by a counter responsive to the received synchronization pulses, which effects a decoding of the received data into parallel format. The data output from the serial-to-parallel converter is fed to switching devices, preferably triacs, which enable the respective light sources forming part of the flashboard or flashboards. These light sources are used to illuminate numbers on the flashboard or flashboards.

The information from the masterboard is encoded into a serial format and time multiplexed to the receiver where it is decoded back into parallel format to light the numbers on the flashboard or flashboards. This decreases the number of interconnection wires from approximately 80 to a minimum of two, in a wired system, and to none in a wireless system. Also the voltage on the wire is reduced from 117 V rms to 5 V peak. The current is reduced from 10.4 amperes per flashboard in the common wire to a total current of less than 0.1 amperes. This allows almost an unlimited number of flashboards to be added to the system as well as accessories. Also the safety factor is increased and required energy reduced. The switches no longer directly power the lamps, consequently they will last longer. Also the lights are switched synchronously with the power line at low voltage levels, so the bulbs should last longer, and the bulb wattage is no longer limited by the switches and wire lengths.

Because the data is in serial format, a simple circuit can be used in a preferred embodiment of this system to cause the last called number to flash on-and-off on the flashboard, while all previously called numbers remain illuminated. The word BINGO on the flashboards can be made to flash at the start of each new game, other information also can be transmitted such as a power-up signal and signals to energize lamps which indicate the start of a game, game number and the like.

DETAILED DESCRIPTION OF THE PREFERRED EMBODIMENT

Figures 1, 4:
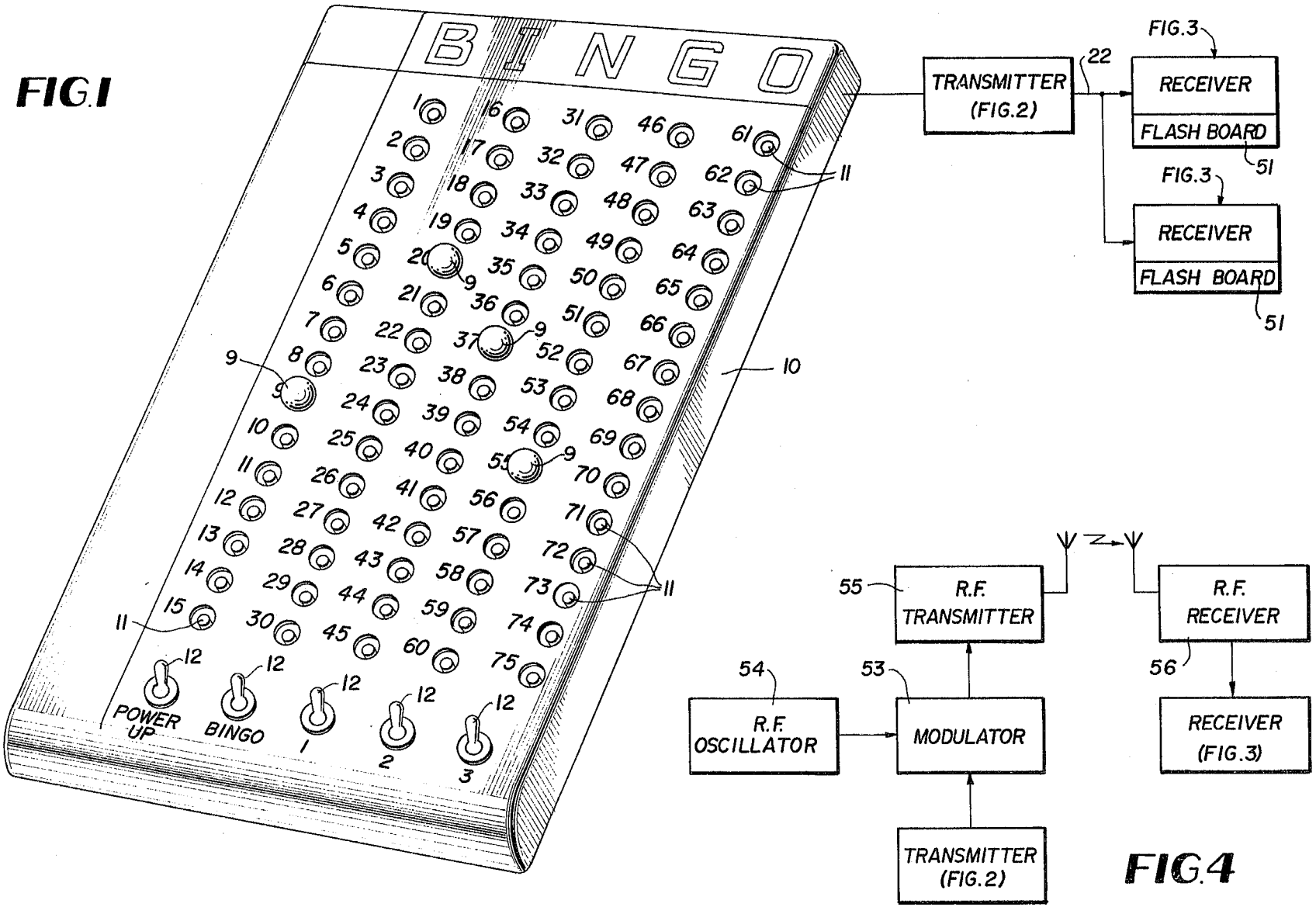
FIG. 1 is a block diagram of an electronic system for use in playing bingo in accordance with the present invention, a masterboard being shown pictorially.
FIG. 4 is a block diagram of a carrier current radio system which may be used to interconnect the receivers and transmitter via power lines.
Figure 3:
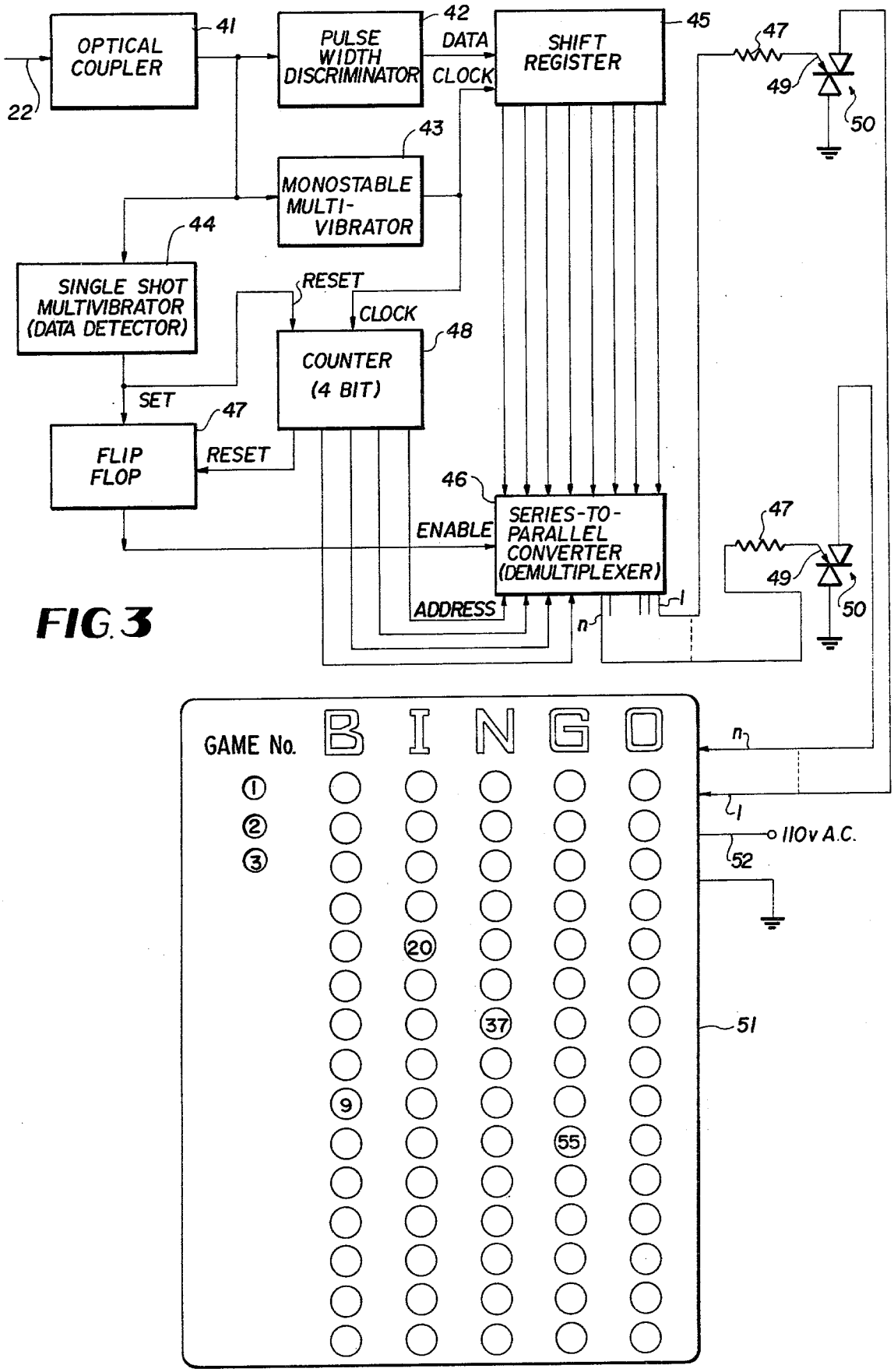
FIG. 3 is a block diagram of an exemplary embodiment of a receiver including a flashboard which may form a portion of a system in accordance with the present invention.

An exemplary electronic bingo game system according to the present invention, as illustrated in FIG. 1, includes a masterboard 10, a transmitter, illustrated in FIG. 1 and at least one receiver and its associated flashboard, shown in FIG. 3.

The system of FIG. 1 includes the conventional masterboard 10 having 75 apertures therein, one for each bingo number. The apertures are of such size that each may hold a respective numbered ball 9, obtained by an operator (caller) from a conventional blower unit (not shown). The apertures are of such a size that the balls 9 are held therein, with the lower portions thereof in contact with respective switches 11 which may be microswitches and are positioned beneath and in close vicinity to the apertures. Four balls 9 are shown in place in selected apertures, as they could be during progress of a bingo game. As shown, the masterboard 10 includes a number of toggle switches 12, five being shown for purpose of illustration. The switches 12 are used to develop signals, under the control of the operator, which are used to produce "game-start" "game-over" "power-up", as well as a signal to enable the text "BINGO" and the like, which are to be fed, as ONE bits to the receiver or receivers and appear on the remote flashboards.

As shown in FIG. 1, the transmitter is arranged to supply input to a plurality of receivers, two being illustrated in FIG. 1. It is to be understood that the system contemplates using a single receiver as well and, in either case, the use of multiple flashboards.

Figure 2:
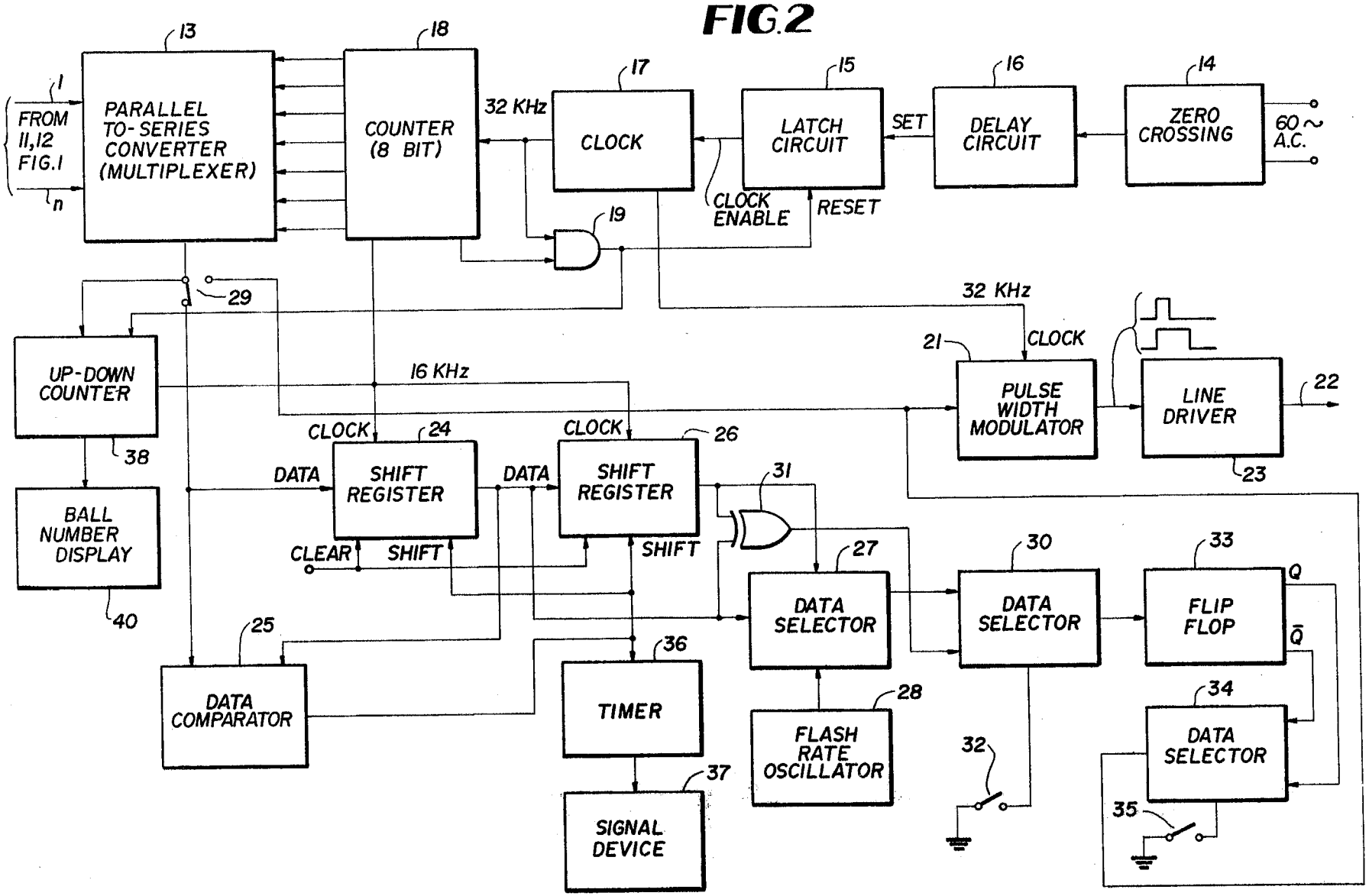
FIG. 2 is a block diagram of an exemplary embodiment of a transmitter which may form, with the masterboard, a portion of a system in accordance with the present invention.

Referring now to FIGS. 1 and 2, the output signals from the masterboard 10 from each of the switches 11 beneath the apertures and the toggle switches 12 are fed to a parallel-to-series converter (time-multiplexer) 13. As shown the respective inputs 1,n of the converter 13 are ONE's whenever the respective switches 11, 12 in the masterboard 10 are closed and ZERO's whenever these switches are open. The converter 13 may be constructed of eight TTL 74150 modules providing a capacity of 128 bits.

A zero crossing detector 14, which receives its input from a 60 cycle A.C. source, is provided for assuring the development of proper synchronization between the transmitter (FIG. 2) and the one or more receivers (FIG. 3) which are powered from the same A.C. source. The output from the zero crossing detector 14 is fed to a latch circuit 15, via a delay circuit 16 which effects a delay of about 200 nanoseconds, sufficient time to assure that the 60 cycle A.C. voltage being supplied to key components of the receiver or receivers has reached about 5 volts, the level required for firing conventional triacs.

The latch circuit 15, which is a bistable multivibrator, produces a pulse output once each one-half cycle of the 60 cycle A.C. power input. The output from the latch circuit 15 is used to synchronize and to enable a clock source 17, which produces a pulse train output having a repetition rate of 32 kHz. The output from the clock 17 is fed to an eight-bit counter 18, which has as a carry output, as its ninth output.

The carry output from the counter 18 and the output from the clock 17 are fed to an AND circuit 19 which, in turn, supplies a RESET input to the latch 15 whenever a clock pulse and a CARRY output are simultaneously received. As a result of this RESET input, the latch 15 turns the clock 17 on for sufficiently long periods that it is on for intervals of such duration that 128 serial bits can be produced by the parallel-to-series converter 13, which is controlled by seven inputs supplied from the counter 18, an eighth output from the counter 18 supplying a pulse train of clock signals having a repetition rate of 16 kHz.

The data output which consists of 128 bits in series format from the converter 13 may be coupled, via one terminal of a double-throw, single pole switch 29 directly to the data input terminal of a pulse width modulator 21 which receives, at its clock input terminal, a pulse train having a repetition rate from the clock 17. The pulse width modulator 21, under the control of the 128 bits received from the converter 13, produces a train of pulses as its output which has a repetition rate of 16 kHz and which consist of short pulses, representing ZERO's and long pulses, representing ONE's in accordance with the conditions of the ball-activated switches 11 and the toggle switches 12 of the masterboard 10.

The width modulated train of pulses from the modulator 21 is fed, in the event the receiver or receivers are at a relatively great distance or constitute a relatively heavy load, to the transmitter output line 22, via a line driver 23. If the distance and load are relatively short and light, the output from the modulator 21 could be fed directly to the line 22.

As thus far described, the transmitter of FIG. 1 can be considered to be complete, although additional circuit components are used in the most preferred embodiment so that additional features and functions can be achieved.

Whenever connection of additional circuit components, which when arranged, as illustrated in FIG. 1, effect the supplying the 128 bits of data to the data input terminal of the modulator 21 in modified form, connection is made from the converter 13 to the data line to a shift register 24 and a comparator 25. It is to be appreciated that the single-pole double-throw switch 29 could be provided between the Data output terminal of the converter 13 so that the data could be alternatively supplied either directly to the modulator 21 or directly to the data input terminal of the first shift register 24 and to one input of a data comparator 25 which has its second input connected to the output of the first shift register 24 which receives, at its clock input terminal, a pulse train having a repetition rate of 16 kHz from the counter 18.

The output from the first shift register 24 is fed to the DATA input terminal of a second shift register 26, which has its CLOCK input terminal connected to receive the 16 kHz pulse train from the counter 18 so that the two shift registers 24 and 26 are synchronized with one another. The data comparator 25 is arranged to produce an output signal whenever the input and output of the first shift register 24 differ, an occurrence which prevails whenever an additional ball is placed in or is removed from anyone of the apertures of the masterboard 10 or when anyone of the toggle switches 12 is changed from one position to another. It is to be appreciated that the two shift registers 24 and 26 could be replaced by other conventional memory devices and, if desired, a single memory could be used.

The signal produced by the data comparator 25 is supplied as a shift signal to the SHIFT inputs of the synchronized memory, shown as a first shift register 24 and a second shift register 26. As a result, the first shift register 24 stores ONE and ZERO signal bits representing the current condition of the ball-activated switches 11 and the toggle switches 12 of the masterboard 10, while the second shift register 26 stores ONE amd ZERO signal bits representing the condition of the switches 11, 12 before the most recent change in their condition.

The outputs from the first and second shift registers 24 and 26 are fed to respective inputs of a first data selector 27, which is a conventional electronic switch, having its control input connected to the output of a free running oscillator 28, which operates at a repetition rate of about two Hz cycles per second. As a result of this arrangement, the first data selector 27 produces, alternatingly at its output terminal, signals representing the present condition of all the switches 11, 12 in the masterboard 10 and signals representing the condition of all switches 11, 12 in the masterboard 10 immediately prior to a change in condition of the last toggle switch 12 or last ball-activated switch 11 activated by the operator.

The output from the first data selector 27 could be fed directly to the modulator 21, unless additional functions are desired. As illustrated, the output from the first data selector 27 is fed to a first input terminal of a second data selector 30 which has its second data input terminal connected to the outputs from the first and second shift registers 24 and 26, via an exclusive OR circuit 31. The second data selector 30, which may be a conventional semiconductor switch, has its control input terminal connected to ground, via a manually operated switch 32. The switch 32, which may be manipulated by the operator, when grounded causes the second data selector 30 to pass the output from the exclusive OR circuit 31, rather than the output from the first data selector 27 to a flip-flop 33 having Q and $\overline{Q}$ outputs. When the switch 32 is closed during the course of a game, the only data which appears as a ONE signal is that bit representing the last switch 11 energized, which is the last number called. As will be explained in more detail below, this allows an operator to clear all flashboards of lighted number representation except the last number called, a distinct advantage while a winner's card is checked so as to avoid the possibility of false winners by using a shill.

The Q and $\overline{Q}$ outputs from the flip-flop 33 are fed to a third data selector 34 which has its control input terminal connected to ground via a manually operated switch 35, which like the switch 32, can be operated by the operator and be a conventional semiconductor switch, effects a choice of data to be fed to the DATA input terminal of the pulse width modulator 21. When the switch 35 is open the ONE's being fed to the DATA input of the modulator 21 represent the respective switches 11, 12 in the masterboard 10 which are closed. When the switch 35 is closed, the ONE's being fed to the modulator 21 represent the respective switches 11, 12 in the masterboard 10 which are open. As a result, the numerals on the flashboard or the flashboards at the receiver or receivers can be, at the choice of the operator, set to all be initially illuminated, becoming individually dark upon activation of the respective ball-activated switches 11 in the masterboard 10 or set to all be initially dark, becoming individually illuminated upon activation of these respective ball-activated switches 11.

If desired, the shift data output signal from the data comparator 25 may be fed to a timer 36 which may be a simple, conventional delay circuit which produces an output signal, for example, after a five second delay, which energizes a signal device 37, which may be either a visual signal device or a tone signal device. The signal device 37 is positioned so that an operator can observe or hear the signal it produces before he places another ball in one of the apertures in the masterboard 10. The operator uses the signal from the signal device 37 for determining his cadence so that he neither "calls" the bingo game too fast or to slow.

It is often desired to count the number of numbers "called" in a bingo game because, in some cases, the prize is particularly determined on the number of numbers required to win a particular game. If desired, the number of numbers "called" can be accummulated in an up-down counter 38 which has its DATA input terminal connected to the data output from the converter 13 and its RESET input connected to the output from the AND circuit 19.

A conventional, visual, digital display 40 is coupled to the output of the counter 38 so that the operator can determine at a glance the number of balls already drawn from the blower device.

As pointed out above, the toggle switches 12 provide part of the data input to the converter 13. Consequently, the up-down counter 38 should be preloaded so that no bits which represent other than signals produced by the ball-activated switches 11 and the toggle switches reach the counter 38. The counter 38 could be preloaded to 53 bits or, if unused inputs are tied to ground, to a negative one to cancel the "BINGO" bit and, in the case other bits are used to send special text, to whatever the appropriate number. While the counter 38 and display 40 can be readily incorporated in the transmitter of FIG. 1, these components are not part of the invention.

Each receiver used in the system of the present invention can be constructed as illustrated in FIG. 3.

As illustrated, the output from the transmitter (FIG. 2) is fed, via the line 22, to the receiver. The exemplary receiver, as shown in FIG. 3, includes an optical coupler 41 having its input terminal connected to the line 22. The isolator or optical coupler 41 is provided to isolate the receiver electrically from the transmitter and the line 22. It is to be understood that in many instances, an optical coupler or other isolator need not be used, for example, none would be required if the transmitter and receiver are positioned relatively close to one another and no significant ground potential differences existed between the transmitter and receiver sides.

The output from the optical coupler 41, which is in the form of a train of pulses composed of pulses of two distinct widths, is fed to a pulse discriminator 42 to a monostable multivibrator 43 and to a single-shot multivibrator 44.

The pulse width discriminator 42 responds to the individual incoming pulses, which have two distinct widths representing respectively ONE's and ZERO's, and produces as its output a train of pulses corresponding only to one or the other of the ONE's or ZERO's; for example, the discriminator 42 can be arranged to produce an output pulse whenever a pulse of the greater width representing a ONE, appears at its input, while producing no pulse in response to the pulses of lesser width. The output from the pulse width discriminator 42 is fed to the DATA input terminal of a shift register 45, which has its CLOCK input terminal connected to the output of the monostable multivibrator 43. The multivibrator 43 produces, in response to the leading edge of each pulse received from the optical coupler 41, a single pulse. Consequently, the data in the shift register 45 is advanced once for each serial bit signal received by the receiver.

The output from the shift register 45 is coupled as the data input to a series-to-parallel converter (time-demultiplexer) 46 which receives at its ENABLE input terminal the output from a flip-flop 47 which, in turn, has its SET input terminal connected to the output from the single-shot multivibrator 44. The reset input terminal of the flip-flop 47 is connected to the CARRY output of a four-bit counter 48, which has its other outputs connected to the ADDRESS input terminals of the series-to-parallel converter 46.

The counter 48 has its RESET input terminal connected to the output of the single-shot multivibrator 44 and its CLOCK input terminal connected to the output of the monostable multivibrator 43.

The time constant of the single-shot multivibrator 44 is such, in relation to the time period required to transmit three bits, that it remains in an unstable condition so long as it receives pulses from the optical coupler 41 without interruption for more than the time period required to transmit three bits. Whenever a period of time expires which exceeds the time for transmitting three bits, the multivibrator 44 produces an output which, via the flip-flop 47, disables the series-to-parallel converter 46 and resets the address counter 48 to zero. The counter is now ready to receive new data and starts on the first pulse from the next data stream (shortly after the next zero crossing). No data pulses appear for each scan to effect a change to a stable condition of the single-shot multivibrator 44.

The series-to-parallel converter 46 can be composed of eight TTL-74154's each arranged to receive one-eight of the data from the shift register 45 and each being capable of providing sixteen respective outputs. Of course, the converter 46 can be selected from many conventional converters.

As illustrated in FIG. 3, the parallel format data from the series-to-parallel converter 46 is fed, via respective resistors 57 to control electrodes 48 of respective triacs 50 which each have one load-current carrying electrode connected to a point of reference potential (ground), while the respective other load-current carrying electrodes are connected, via respective lamps within a flashboard 51 to a 110 volt A.C. main 52, so as to effect illumination of these lamps upon firing of the respective triacs 50. As shown, the lamp associated with the bingo numerals B9, I20, N37 and G55 are shown to be illuminated. These particular lamps correspond to the switches 11 which have been closed by the respective balls 9 shown to be in place on the masterboard 10 (FIG. 1). It is to be understood that the triacs 50 are shown by way of example. Other types of switching devices could be used. Among these are SCR's, SCR's connected back-to-back, semiconductive devices of other types, thyratrons, electromechanical switches and the like. It is to be appreciated that the lamps used to illuminate the numerals on the flashboard could be replaced by other conventional indicators, such as electro-mechanically operated members carrying plates with numerals thereon.

Before turning to a brief description of operation, a variant of the system, illustrated in FIG. 4, is to be considered. The foregoing description is connected with an illustrated embodiment in which the transmitter and receiver are connected via the line 22. It is to be appreciated that the transmitter and receiver could be linked using other techniques. The receiver and transmitter could be linked by wireless techniques, for example by a radio link, as illustrated in FIG. 4. As shown in FIG. 4, the transmitter of FIG. 2 could have its variable width pulse signals coupled to a modulator 53 which receives a radio frequency signal from a radio frequency oscillator 54. The radio frequency signal is modulated by the pulses. The output from the modulator 53 is fed to a conventional radio frequency transmitter 55. A conventional radio frequency receiver 56 is arranged to receive the signals from the transmitter 55 and to effect demodulation of the received signals. The resulting variable width pulse signals are, in turn, fed to the receiver (FIG. 3). It is to be understood that when using the radio frequency variant, the transmitter of FIG. 2 would not include the line driver 23 nor would the receiver of FIG. 3 be provided with the optical coupler 41. It is to be understood that although antennae are shown in FIG. 4, it is contemplated that carrier current coupling via power lines between the radio transmitter 55 and the radio receiver 56 would be particularly advantageous. Other wireless techniques, such as light beams, particular coherent light beams, could be used to effect links between the transmitter and the receivers. Although a signal radio receiver is shown in FIG. 4, it is to be appreciated that a plurality of receivers could be used and spaced at considerable distances from one another. Each radio receiver could be associated with multiple receivers of the construction shown in FIG. 3 and multiple flashboards could be associated with each of these receivers.

To operate the system illustrated in FIGS. 1 through 3, the power to the transmitter (FIG. 2) and the receiver (FIG. 3) is turned on or the units simply plugged into respective A.C. Mains, as the case may be. The operator, having decided on a particular mode of operation, opens the switches 32 and 35 and places the switch 29 in the position shown.

The operator then simply turns the ON switch on the masterboard 10 to its "ON" position to effect an application of operating voltages to the components of the transmitter of FIG. 2 in a conventional fashion. He then turns that one of the switches 12 associated with a given bit position to effect the application of operating voltages to the components of the receiver of FIG. 3. This signal is also supplied to the CLEAR inputs of the shift registers 24, 26. He then turns on that one of the switches 12 which is associated with the legend BINGO which causes the word BINGO to become illuminated and flash on and off on the flashboard 51 indicating that the game is about to start.

As the game proceeds, the operator withdraws numbered balls from the blower unit (not shown) and places them in the respective numbered apertures in the masterboard 10. As shown numbered balls have been placed in the B9, I20, N37 and G55 apertures, causing the respective microswitches 11 beneath these apertures to close. As a result, signals corresponding to position of the "power up" and "bingo" switches 12 and the four depressed aperture switches 11 appear as parallel input signals to the parallel-to-serial converter 13. These signals are passed into the shift register 24 and thence to the shift register 26, under the control of the data comparator 25. The outputs from the respective registers 24, 26 are fed, via the exclusive OR circuit 31, the flip-flop 33 and the data selectors 27, 30 and 34 to the pulse width modulator 21 which produces a train of pulses, under control of output from the clock 17, having pulses of two distinct widths, the longer width representing ONE's and the shorter width representing ZERO's.

The output from the modulator 21 is fed via the line 22, possibly after amplification by the driver 23, to the receiver shown in FIG. 3.

The received variable width pulses are processed in the optical coupler. Output from the coupler 41 is discriminated by the pulse width discriminator 42 which produces a train of pulses representing ONE's which are supplied to the shift register 45. The output from the shift register 45 is supplied to the series-to-parallel converter 46 which under the control of the counter 48 and the flip-flop 47, produces output signals in parallel format corresponding to the position of the switches 11, 12 at the transmitter as stored in the shift registers 24, 26, which reflect the current condition of these switches so far as the content of register 24 is concerned, and the previous condition which prevailed just before position of the last one of the switches 11, 12 was changed, so far as the content of the register 26 is concerned.

The respective outputs from the converter 46 are supplied to the individual control electrodes of the plurality of triacs 50, there being one triac for each lamp within the flashboard 51 and a further number, each serving a particular function, such as to effect the initial applications of operating voltages to the components of the receiver. Since the A.C. operating voltages supplied to the current carrying electrodes of the triacs 50 are supplied from the same principal source which feed the input A.C. power to the zero-crossing detector 14 and a particular delay is effected by the delay circuit 16, it is to be appreciated that the triacs 50 are always fired only during a given early part of a given one-half wave of the 60 cycle voltage supplied. Thus, each of the lamps within the flashboard 51 will, when on, be as bright as the others and it is also assured that the voltage will have at least reached a given turn-on level, about 5 volts, at any time a signal is received which fires the respective triacs 50.

Let it be assumed that at first no ball was present in an aperture of the masterboard 10, but the BINGO switch 12 is on. The word BINGO on the flashboard 51 would flash until the first ball, for example, ball B9 is placed on its associated aperture. The word BINGO would then remain illuminated and the number B9 on the flashboard 51 would flash and so on until a final winning ball, for example 072 were placed in its associated aperture in the masterboard 10. The last number would continue to flash; however, the operator could clear the flashboard of all but the last number by simply closing the switch 32 so that the players would not know what any but the last-called number was.

During the game, the operator can observe the number of balls played by simply looking at the display 40 and, if desired, can set his pace by observing or hearing signals from the signal device 37. In the event the operator desires, an entire game could be played with the switch 32 closed. In this instance, only the last number called would be illuminated on the flashboard 51 at any given time during the game. All numbers would remain stored in the register 24 and thus could be displayed at the end of a game, after checking the card of a winner. If the operator wishes to conduct a game with all lamps initially illuminated, he need simply to close the switch 35, the lamps being turned off for placement of a corresponding ball in one of the apertures of the masterboard 10.

It is to be appreciated that the foregoing description has been set out by way of example, not by way of limitation. Numerous other embodiments and variants are possible within the spirit and scope of the invention, its scope being defined by the appended claims.

What is claimed is:

1. An electronic system for use in playing bingo wherein a plurality of players are each provided with a game card, the system comprising a transmitter including a masterboard for delivering signals in parallel format representing numbers in a bingo game, parallel-to series converter means responsive to the output of said masterboard for converting the signals in parallel format into signals in series format, and means for sending signals in a single train of pulses in series format to at least one location, and at least one receiver at said one location including series-to-parallel converter means responsive to signals received for converting said signals in series format to signals in parallel format representing the numbers in a bingo game, a flashboard having numerical indicia thereon representing said bingo game numbers, said flashboard being disposed for view by said plurality of players, means on said flashboard for visually activating said numbers on said flashboard, means for connecting said visually activating means to said series-to-parallel converter means whereby said visually activating means is responsive to signals from said series-to-parallel converter means for visually activating the numbers of a bingo game on said flashboard.

2. An electronic system for use in playing bingo according to claim 1, wherein said means for delivering signals in parallel format comprise a masterboard including a plurality of apertures into which numbered balls may be placed, a plurality of sensors positioned in proximity of said apertures to sense the presence of balls in said apertures.

3. An electronic system for use in playing bingo according to claim 2, wherein said sensors are constituted by respective switch means.

4. An electronic system for use in playing bingo according to claim 2; wherein said transmitter includes memory means for storing data representative of current and immediately preceding condition of said sensors, and means for alternatingly supplying output from said memory means to said means for sending.

5. An electronic system for use in playing bingo according to claim 2, wherein said transmitter includes a pair of shift registers for storing data representative of current and immediately preceding conditions of said sensors, and means for alternatingly supplying output from said pair of shift registers to said means to sending.

6. An electronic system for use in playing bingo according to claim 2, wherein said transmitter includes means for supplying alternatingly data representing current and immediately preceding condition of said sensors to said means for sending.

7. An electronic system for use in playing bingo according to claim 1, wherein said means for sending include a line driver.

8. An electronic system for use in playing bingo according to claim 1, wherein said means for sending includes wireless transmitting means.

9. An electronic system for use in playing bingo according to claim 8, wherein said wireless transmitting means are carrier current transmitter means.

10. An electronic system for use in playing bingo according to claim 1, wherein said flashboard includes indicator means for each bingo number.

11. An electronic system for use in playing bingo according to claim 10, wherein said indicator means comprises light producing means.

12. An electronic system for use in playing bingo according to claim 10, including respective control means in series with each said indicator means, a control electrode of each said control means being coupled to a respective output of said series-to-parallel converter means.

13. An electronic system for use in playing bingo according to claim 12, wherein said respective control means are respective triacs.

14. An electronic system for use in playing bingo according to claim 13, wherein each said indicator means comprises a respective light producing means.

15. An electronic system for use in playing bingo according to claim 1, including means for syncronizing said transmitter and each said receiver.

16. An electronic system for use in playing bingo according to claim 1, wherein said means for sending includes pulse width modulating means for producing a pulse train in which pulses of one width represent ZERO's and pulses of a second width represent ONE's.

17. An electronic system for use in playing bingo according to claim 16, wherein said receiver includes pulse width discriminating means responsive to signals sent by said transmitter for developing a pulse train representing received pulses of a given width.

18. An electronic system for use in playing bingo according to claim 1, wherein said means for sending includes radio transmitting means.

19. An electronic system for use in playing bingo according to claim 18, wherein said radio transmitting means are carrier current transmitter means.

* * * * *